US008013884B2

(12) United States Patent
Schlinkmann et al.

(10) Patent No.: US 8,013,884 B2
(45) Date of Patent: Sep. 6, 2011

(54) DEVICE AND METHOD FOR PRINTING INFORMATION ON GLASS SURFACES

(76) Inventors: Jamie P Schlinkmann, Coconut Creek, FL (US); Alex W Schlinkmann, Parkland, FL (US); Antinio L Haubrich, Sunrise, FL (US)

( * ) Notice: Subject to any disclaimer, the term of this patent is extended or adjusted under 35 U.S.C. 154(b) by 688 days.

(21) Appl. No.: 12/147,407

(22) Filed: Jun. 26, 2008

(65) Prior Publication Data

US 2009/0223390 A1 Sep. 10, 2009

Related U.S. Application Data

(60) Provisional application No. 61/035,016, filed on Mar. 9, 2008.

(51) Int. Cl.
*B41J 2/325* (2006.01)
*B41J 3/407* (2006.01)
*B41F 17/00* (2006.01)

(52) U.S. Cl. ..... 347/171

(58) Field of Classification Search ..... 347/171, 347/215, 218; 101/35
See application file for complete search history.

(56) References Cited

U.S. PATENT DOCUMENTS

| | | | | |
|---|---|---|---|---|
| 5,683,786 | A | 11/1997 | Kavanaugh | |
| 5,963,368 | A | 10/1999 | Domanik et al. | |
| 6,615,763 | B2 | 9/2003 | Edwards | |
| 6,629,792 | B1 | 10/2003 | Geddes et al. | |
| 6,951,663 | B1 | 10/2005 | Edwards | |
| 7,124,681 | B2 * | 10/2006 | Louviere et al. | 101/37 |
| 2001/0039896 | A1 | 11/2001 | Edwards | |
| 2005/0094263 | A1 | 5/2005 | Vaccarelli | |
| 2010/0050888 | A1 * | 3/2010 | Fujimoto et al. | 101/35 |

* cited by examiner

*Primary Examiner* — Huan H Tran
(74) *Attorney, Agent, or Firm* — Gold & Rizvi, P.A.; Glenn E. Gold; H. John Rizvi

(57) ABSTRACT

A printing device transfers slide dependent information onto glass surfaces such as a glass slide for holding a medical specimen. A single slide is transferred from a storage section, passing under a thermal print head. The thermal print head defines and transfers an image from an ink media onto the slide as the slide passes across the print head. The print head utilizes pixel like heating elements to apply the desired image. The ink media moves in tandem with the motion of the slide, presenting a continuously fresh section of ink between the print head and the slide throughout the printing process. The information on the slide should be both human and machine readable to reduce any chances of misidentification of the specimen as to the patient. The ink media is endures any chemical processes and handling encountered throughout the expected life of the slide.

20 Claims, 6 Drawing Sheets

DEVICE AND METHOD FOR PRINTING INFORMATION ON GLASS SURFACES

CROSS-REFERENCE TO RELATED APPLICATION

This Non-Provisional Utility application claims the benefit of U.S. Provisional Patent Application Ser. No. 61/035,016, filed on Mar. 9, 2008, which is incorporated herein in its entirety.

BACKGROUND OF THE INVENTION

1. Field of the Invention

The present invention relates generally to the attachment of information to objects, and, in particular, to the attachment of medical information to objects used in testing of specimens, and, in greater particularity, to a device and method of attaching medical information to glass surfaces such glass slides during the processing of these slides.

2. Description of the Prior Art

In the field of medical diagnostic testing, it is critically important to ensure that testing results are matched with the correct patient; otherwise, in the worst case, patients may die, and providers of services could be and are faced with substantial damage claims and awards.

This is not usually a problem when an x-ray or MRI or other testing is done, where the patient's information may be permanently printed directly onto the x-ray sheet by the testing machine, for example, as the testing is being prepared for or done or thereafter. The potential for error here is minimal, since only one patient is typically being tested at a time, and the operator/technician of the machine is either in the room or in an adjacent room where viewing of the patient is possible. The patients are normally scheduled in advance and the patients typically wear hospital provided identification bracelets for ease of verification at the point of testing. Further, the patient is able to view his/her own testing results, i.e., by examining the x-ray sheet. This clearly does not prevent incorrect evaluations.

The problem of matching the patient information to a particular specimen slide becomes much more of an issue in a diagnostic testing laboratory where hundreds, if not thousands, of slides are processed daily. In such an environment, there are many distractions such as, for example, background noise, talking, and cell phones ringing. Additionally, errors may result from operator skill level limitations, workstation clutter, etc.

It is thus important to be able to provide a human and machine readable identification exactly at the point the specimen is being attached to the slide. It is further desirable to have a machine that provides this ability situated directly at the workstation of the technician. It is further necessary to have a device capable of applying patient information to the slide in a manner that is durable and not distorted by chemical and/or mechanical processing involved in modern clinical diagnostic laboratories. This device should not interfere ergonomically with other equipment at the workstation or audibly/visually interfere with the technician's environment.

Presently, there are devices and methods for marking slides which do not include the beneficial features of the present invention; namely, printed labels that are applied to the slides by hand or machine, ink jet printers that apply printed information onto the slide with special ink, laser marking of the slide, and diamond scribing of the slide. These machines are typically large, heavy, complex, and expensive. Laboratories using these techniques use a "batch-mode" where the slides are marked and then later matched up with their appropriate specimens. A further disadvantage is the cost of operating these machines, especially the labeling and ink jet machines. Some of the current machines are the Leica IPS Ink Jet Slide printer, the Thermo Scientific Shandon Laser MicroWriter, the Thermo Scientific Shandon Microwriter, and the General Data StainerShield Slide Labeler Printer Applicator.

There are known systems, devices and processes, for placing patient information on slides. For instance, one such system provides a workstation for examining previously marked slides fed from a carousel. Information regarding the examination is placed on the printing area of the slide by means of an ink jet printer. There is no ability therein to verify that the initial slide information is correct. Another system provides a storage device having a plurality of slides which are fed out onto a belt where there is a printing station using an ink jet printer. A special ink composition is used, further increasing the cost. Another method employs the use of a laser beam to etch or burn away a coating on the slide to produce a bar code pattern for example. This process produces dust byproduct, as well as a potentially hazardous laser beam.

Accordingly, there is an established need for a printing device using an economical method that very accurately matches and places patient information on patient specimen slides, which provides these features with a maximum of flexibility for use in a diagnostic laboratory.

SUMMARY OF THE INVENTION

The present invention is provides a device and method of printing medical information on glass specimen slides.

Additionally, means are provided for transferring information onto glass surfaces, such as a glass medical slide for holding a medical specimen. A person or an input device inputs the medical information into a processor that prepares a rasterized image to be printed and stores this image in a memory of the processor. A single slide is removed from a slide storage section, indexed in a slide carrier to initialize the printing and transports this slide under a print heading to an initial printing position. An ink media tape roll acting through a driven feeder provides, in a controlled manner, a coated tape between a print head and the slide. The print head and slide are pushed together so that the pixel-like heating elements engage the tape to transfer, by a direct contact thermal process, an inked media onto a slide surface defined by the stored image. The printing device then advances the tape and indexes the slide to the next print row and repeats the transfer processes. This process is repeated until the desired information is transferred to the slide. After printing the last row of data, the print head and slide move to a non-contact position, and the slide transport moves the carrier with the completed slide to an output section, where the slide is mechanically removed into the output section. This process is repeated as many times as necessary as determined by the operator. The information on the slide should be both human and machine readable to reduce any chances of misidentification of the specimen, particularly vis-à-vis the patient. The ink media on the slide must be permanent regardless of the chemical and mechanical processes to which the specimen is subjected. The printing device is hand portable and is placed in close proximity to the laboratory technician placing the specimen on the slide.

An object of the present invention is to provide a means to very accurately match patient identification to the patient's specimens. This is further ensured by having the printed information both human and machine readable at the point where the specimen is attached to the slide.

It is another object of the present invention to provide a small printing device that may be easily positioned at the technician's workstation without interfering ergonomically with other equipment located thereat and by also minimizing audible and visual effects.

It is a further object of the present invention to provide printed information on the slide surface that will withstand the chemical and mechanical processing involved for that particular slide, particularly in a modern clinical diagnostic laboratory environment.

It is still a further object of the present invention to provide a printing device and method capable of processing thousands of slides per day.

It is yet a further object of the present invention to provide a printing device sufficiently flexible in design to be able to receive single slides by hand, stacked slides, slides held in a carousel, and slides supplied by a conveyor system.

While yet another object of the present invention is the ability to print specific information onto a slide upon demand.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Figure 1A:
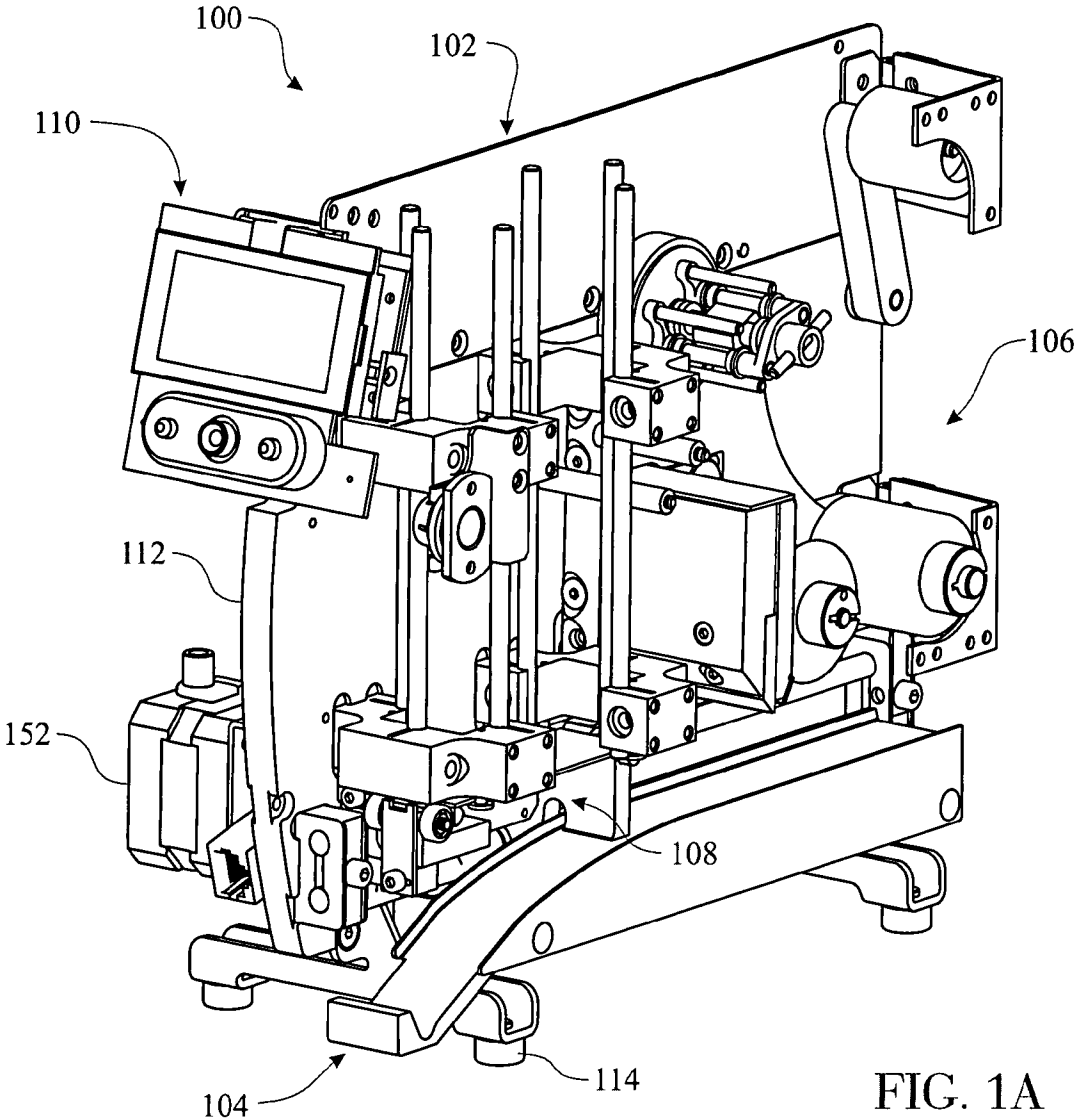
FIG. 1A is a front side perspective view, from the output side, of the printing device of a preferred embodiment of the present invention.

The present invention is directed at a printing device that transfers information onto glass surfaces, particularly, glass medical slides for holding medical specimens.

In pathology laboratories, tissue samples are embedded into wax cassettes and then sliced into 3 to 5 micron layers, and these layers are attached to glass microscope slides. At this point, the slides must be correlated with the cassette (patient) identification and further identified to differentiate slides of the same specimen from one another. The processing of the slides involves many chemical dyes and "rinses," which, in some instances, comprise heavy solvents such as xylene. The printing on the slides requires survivability and readability, as this is critical to accurate patient test analysis. The information on the slides can include information from the identification on the cassette, as well as information pertaining to the Laboratory Information System (LIS), for example. At a minimum, the information on a slide typically includes the patient name, additional patient identifier(s), bar-coding (e.g., type/no. of characters unknown), slide number, and the total quantity of slides from that specimen, for example. Typically, one to eight slides are created from each cassette, and, on average, three; however, the operator can determine the quantity of slides to be created/identified. Further, a damaged slide must be replaced with identical information.

In light of the working environment of the laboratory, the printing device of the present invention should be small and be able to fit upon a small shelf or on top of a microtome. The consumables of the device should be minimized and, preferably, should require only standard commercially available products during use. The operations of the printing device should be as simple as possible and minimize operator intervention, such as, for example, that required during single slide loading methods.

The specifications for such a printing device are important for its marketability and use. It should accept bulk slides that range in size, optimally 25×75 millimeters. Conventionally, slides have a thickness of 1 millimeter. One end of the slide may be frosted or colored (approximately a ¾ inch portion), providing the printable area. Slides may have rounded corners or square corners. The printing device should output approximately one slide every four seconds. Preferably, the printing on the slide should be at least about 600 dpi resolution. The printing may include ID barcode data, 2-D barcode data, and normal legible text. Registration of the print should be +/− 0.2 millimeters. The printing device should operate from a standard A/C wall outlet. The output section of the printing device should hold at least 10 slides and it should be easy to remove the slides therefrom. Preferably, the device should have a maximum size of about 8.5 inches wide by 11.0 inches deep by 7.0 inches tall. The printing device should have a cover that is easily cleaned and also a user interface that is adjustable in direction to accommodate different operating locations and different operator heights. The printing device may interface with external equipment via an Ethernet network that is connected to the LIS, for example. When the operator scans the cassette, the LIS may generate print data and output the data to the printing device which, in turn, prints on identified slides. Alternatively, the interface via the Ethernet network can connect to the LIS and, when the operator scans the cassette, the LIS communicates commands and ASCII information to the printing device, which generates print data and outputs appropriately identified slides. Additionally, the printing device may interface with a 2-D barcode scanner. When the operator scans the cassette, the device generates print data and output slides based on the cassette information and the slide number.

In general, a person or an input device inputs the medical information into a processor, such as by means described above, which prepares a rasterized image to be printed and stores this image in a memory of the processor. A single slide is removed from a slide storage section, indexed in a carrier to initialize the printing, and transported to a print head to an initial printing position. An ink media tape roll acting through a driven feeder provides a coated tape between the print head and the slide. Pixel-like heating elements transfer, by a thermal process, an inked media by direct contact onto the slide as determined by the stored image. The printing device then advances the tape and indexes the slide to the next print row and repeats the transfer processes. This process is repeated until the desired information is transferred to the slide. After printing the last row of data, the print head moves to a non-contact position, and the slide transport moves the carrier with the completed slide to an output section, where the slide is mechanically removed into the output section. This process is repeated as many times as necessary as determined by the operator. The information on the slide should be both human readable and machine readable, to minimize potential for misidentification of the specimen vis-à-vis the patient. The ink media on the slide must be permanent; regardless any chemical processes used upon the specimen and any mechanical/handling requirements. The printing device is portable and is placed in close proximity to the laboratory technician placing the specimen on the slide, thereby minimizing any misidentification.

Turning to the drawings, wherein like components are designated by like reference numerals throughout the various figures, attention is initially directed to FIG. 1, which illustrates a front perspective view of a slide printing device constructed according to the present invention. It should be understood that although the present invention primarily relates to printing on glass slides, contemplated modifications thereto will enable adaptation to print on a variety of objects having a variety of geometries, including, for example, plastic slides, glass or plastic test tubes, and cassettes, to name just a few.

As best shown in FIG. 1A, the slide printing device 100 includes a slide storage section 102, a slide transport section 108, a slide output section 104, a printing section 106, and a user interface section 110. Additionally, these sections are mounted to a frame 112 having a plurality of supports 114. It should be further understood that a removable cover, not shown, encloses these items as necessary.

Figure 2:
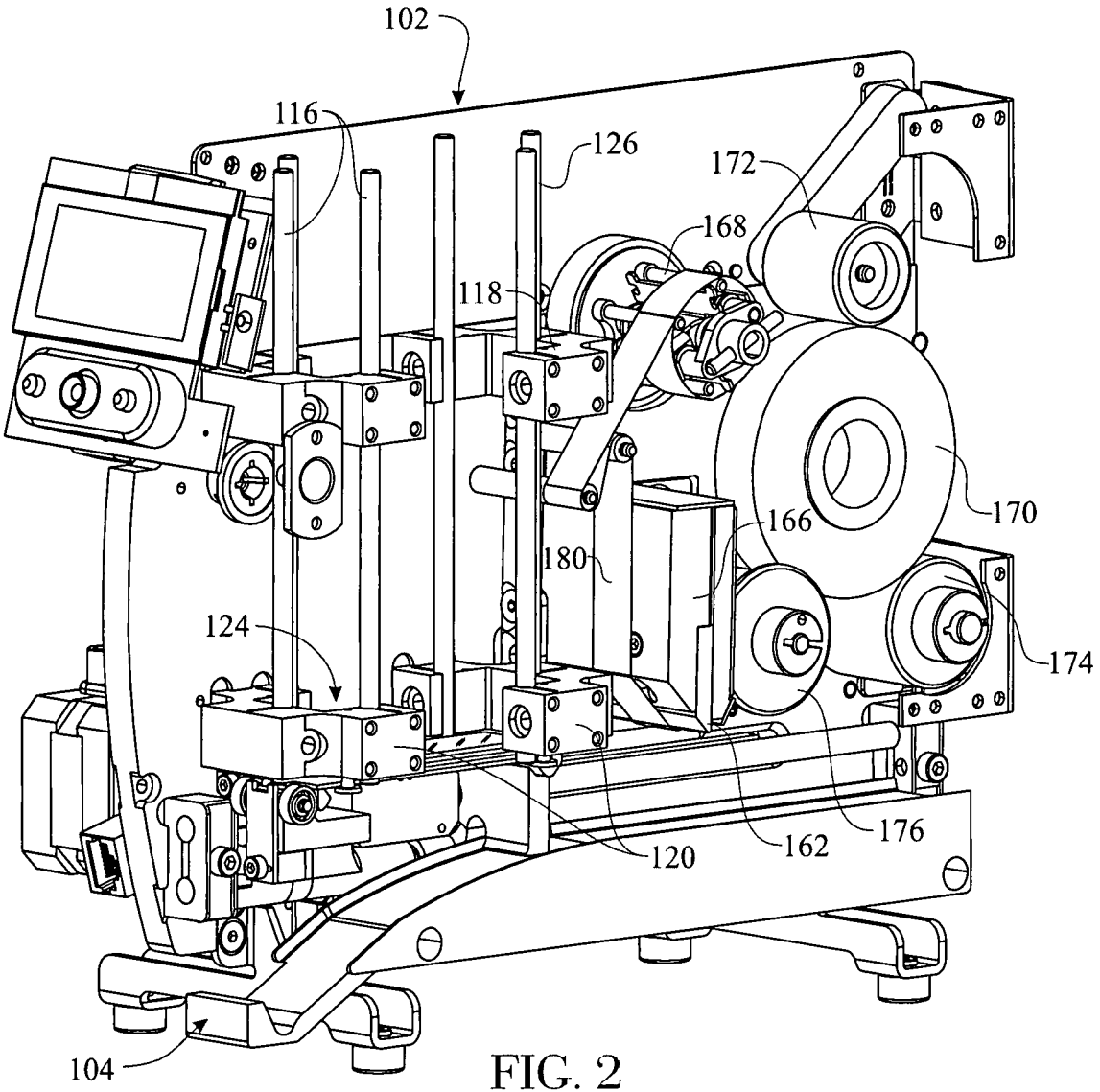
FIG. 2 is a front side perspective view, being at a different angle and closer, of the printing device as shown in FIG. 1A of the present invention.

FIG. 2 illustrates by a perspective front view, an enlarged view of FIG. 1A. A plurality of slides, not shown, is loaded into the slide storage section 102 between six vertically positioned rods 116 held in position by four brackets 118, two per three rods. The lower two brackets 120 are U-shaped, facing each other, and have a rectangle void 124 therebetween, for closely holding the slides. A bottom slide, not shown, is seated, or rests, upon a small shelf bracket, not shown, on the frame 112, which prevents the slides from falling from the storage section 102. A rear vertical rod 126, has a bottom part (not shown) removed, which slightly thicker than a slide, so that the bottom slide may be removed from the stacked slides by a pushing action from a slide carrier 128 (advancing to the right in FIG. 3).

Figure 3:
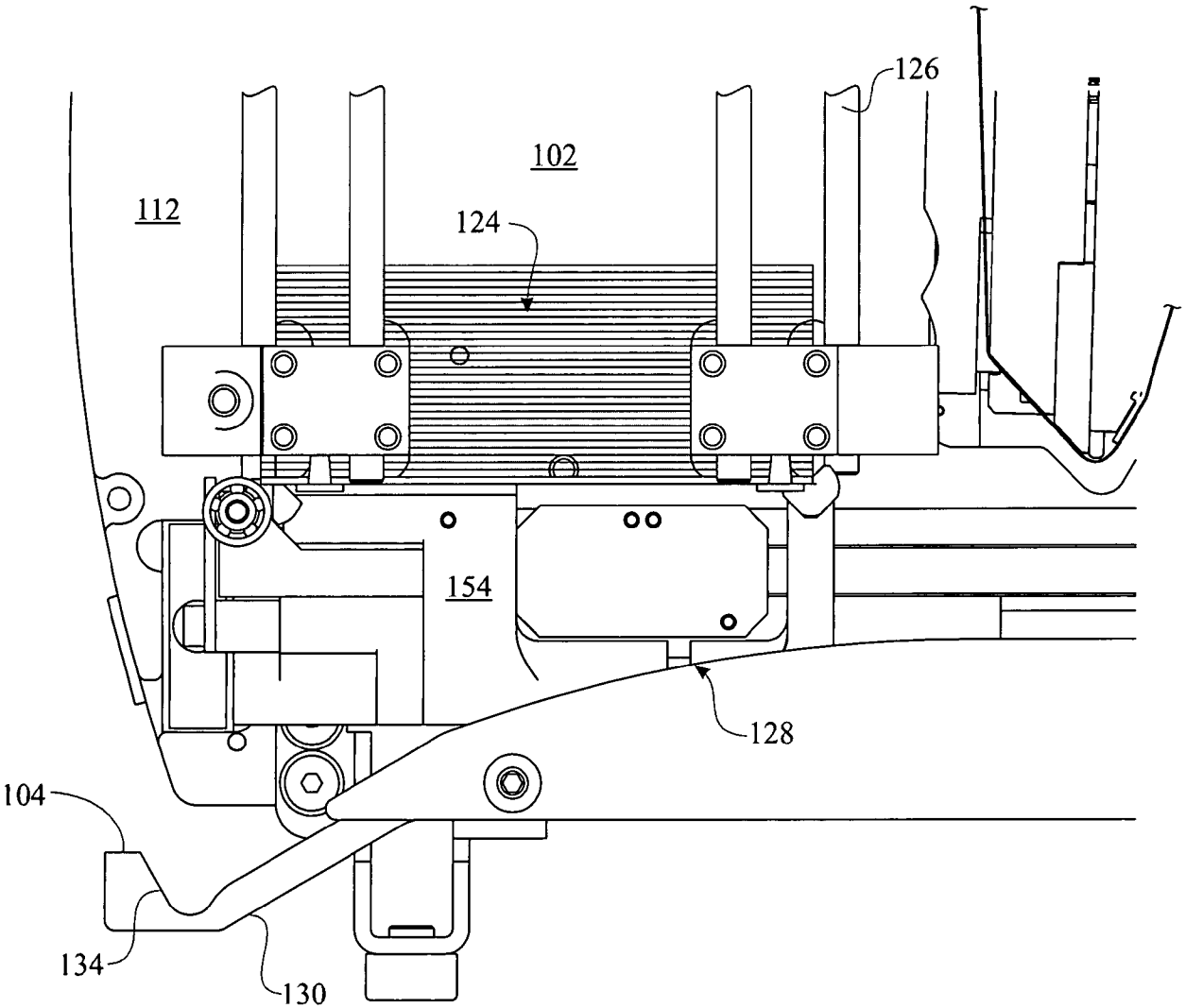
FIG. 3 is a front side view partially showing the bottom of the slide storage section, slide shuttle thereunder, and the output section, of the printing device as shown in FIG. 1A of the present invention.

In FIG. 3, the slide output section 104 includes a tapered ramp 130 sloping downward toward the left side of the printing device 100. The top section of the ramp 130 is located under the slide storage section 102 to catch slides falling from a slide carrier 128. This glass slide having the printed information disposed thereon slides down the ramp 130 and comes to rest against a stop 134. Each subsequent glass slide is stacked upon the top of the previously printed slide. Approximately ten slides may be held thereon, but modifications thereto may allow additional slides or other devices to remove the slides therefrom for further processing.

Figure 1B:
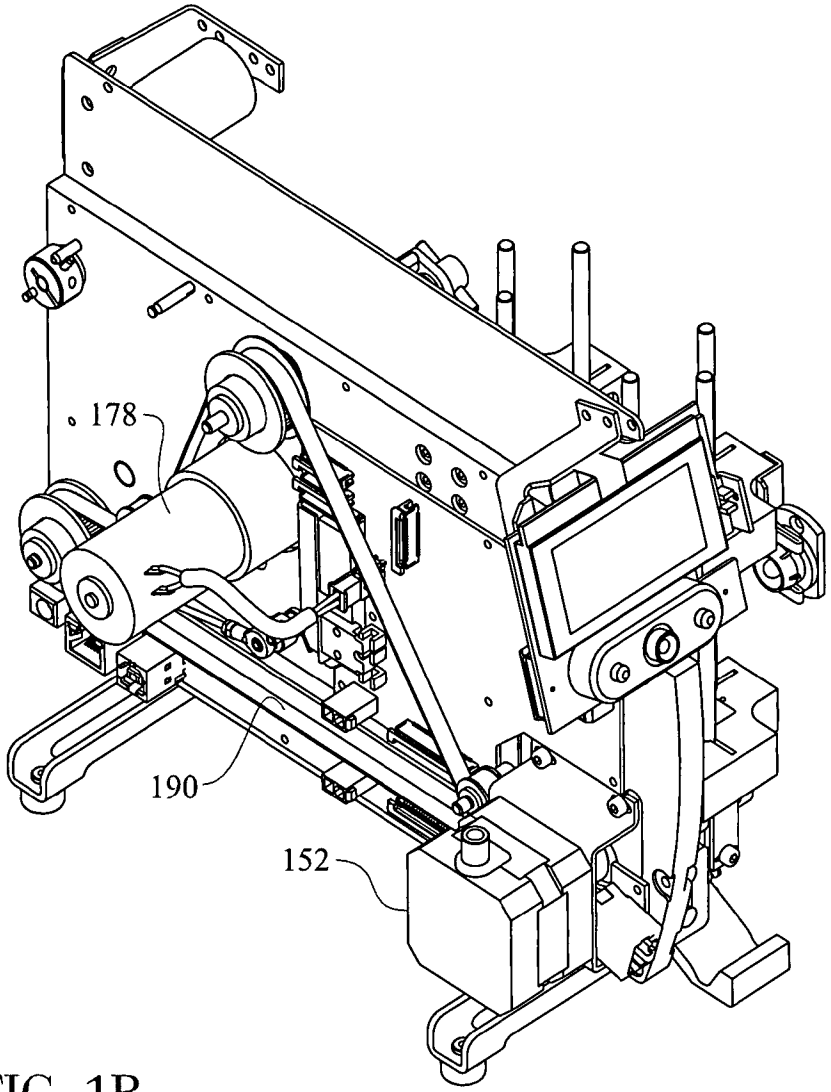
FIG. 1B is a rear side perspective view, from the output side, of the printing device as shown in FIG. 1A of the present invention.
Figure 4:
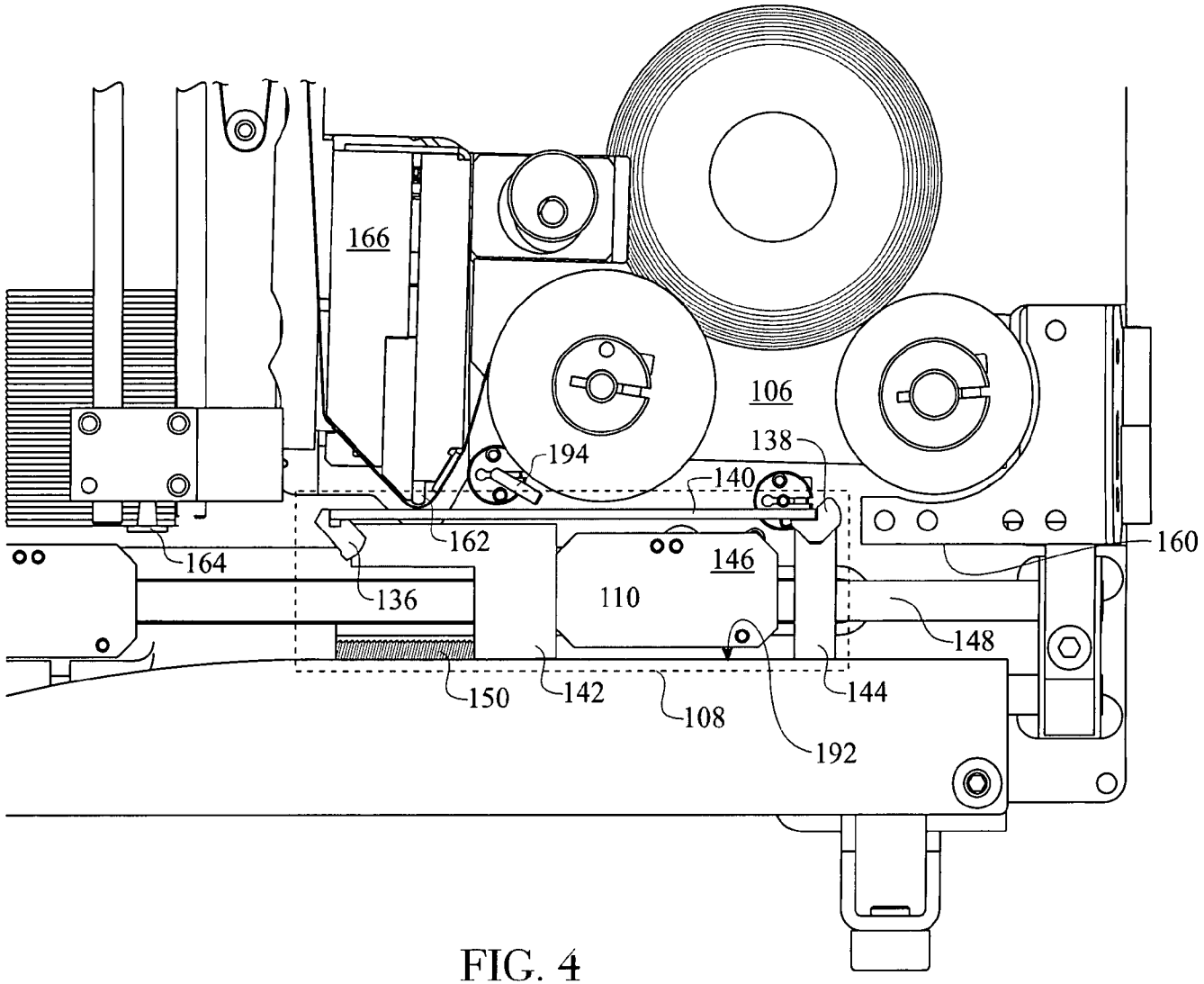
FIG. 4 is a front side view partially showing the printing section with the slide shuttle thereunder of the printing device as shown in FIG. 1A of the present invention.

The slide transport section 108 is further illustrated in both FIGS. 3 and 4. FIG. 3 illustrates the carrier 128 under the slide storage section 102 and FIG. 4 illustrates the slide carrier 128 under the printing section 106. As seen therein, the slide carrier 128 includes a left slide support jaw 136 and a right slide support jaw 138 (hereinafter "left jaw" and "right jaw") that precisely hold a slide 140 therebetween. The slide support jaws 136 and 138 are mounted on supports 142 and 144, respectively. These supports are slidably mounted to a pair of guide shafts 148 and through a belt 190 and are translated back and forth thereon by a stepper motor 152 (FIGS. 1A and 1B).

Figures 5A, 5B, 5C:
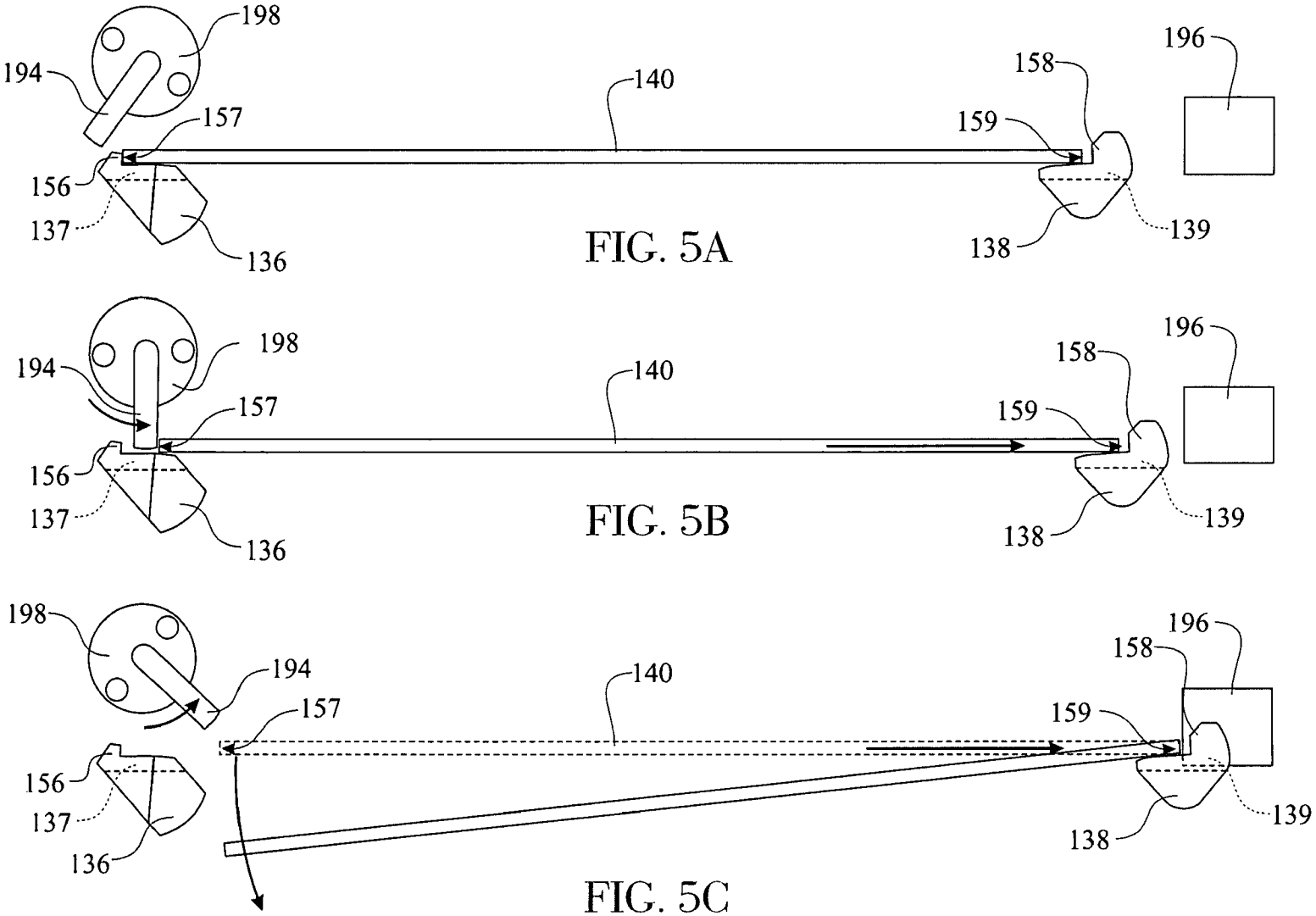
FIGS. 5A, 5B, and 5C is front side view of the slide supports of the carrier of the printing device as shown in FIG. 1A of the present invention, showing the slide releasing process.

In order to initially remove the slide from the slide storage section 102, the left jaw 136 is provided. As the slide shuttle 154 moves to the right, the left jaw 136 has a projecting lip 156 (FIG. 5A) that abuts the front end 157 of the slide 140, and pushes it from the bottom of the stack. The rear end of the slide 140 falls into the right jaw 138, as shown in FIG. 4. The slide shuttle 154 with the slide 140 therein, then moves to the right until the desired section of the slide 140 is under a print head 162.

After the printing of the patient information on the slide 140, further described below, the slide shuttle 154 moves to the right to eject the slide into the output tray 192. The slide transport section 108 consists of multiple components as presented in FIGS. 4 and 5. The slide removal process is detailed in FIGS. 5*a* through 5*c*. The slide 140 is supported with the front slide end 157 residing against a left jaw projecting lip 156 and a rear slide end 159 residing against a right jaw projecting lip 158. The drive guide 146 engages with the drive system located in the rear of the machine, with the left jaw support 142 and the right jaw support 144 being held to the drive guide 146 via springs (not shown). As the drive guide 146 moves towards the right and once the left jaw 136 passes the print head 162 area, the left jaw support 142 engages with a stop (not shown), causing the left jaw 136 to stop. The right jaw 138 is coupled to the right jaw support 144, which continues to move, creating a gap between the left and right jaws. The gap is large enough for the slide 140 to drop into the output tray 192. This transfer is assisted by an actuator arm 194 as it rotates counterclockwise, passing through a left jaw slot 137 and moving the slide 140 towards the right side. The left jaw slot 137 is a clearance slot that is laterally located along the upper section of the left jaw 136. The rotational motion of the left slide actuator arm 194 is provided via an ejector hub 198, which is actuated by a radial linkage and the drive guide 146. When the drive guide 146 approaches the end of the stroke, a stationary right slide ejector 196 passes through a right jaw slot 139 of the right jaw 138 ensuring the slide is transferred onto the output tray 192 by applying a force (not shown) to the rear slide end 159 of the slide 140, causing the slide 140 to drop onto the output tray 192. The right jaw slot 139 is a clearance slot that is laterally located along the upper section of the right jaw 138. The motion then is reversed with the components of the slide transport section 108 moving towards the left, registering with the slide storage section 102 (FIG. 3) to acquire another slide and repeat the printing process. During this leftward motion, the right jaw guide 144 engages with and transports the ejected slide 140 to the output section of the output tray 134.

Referring particularly to FIGS. 1A and 2, the printing section 106 includes a printing head assembly 166 with a print head 162, a take-up reel 168, an ink tape roll 170, a tension roller 172, a driven roller 174, a support roller 176. The printing head 166 is connected to a motor 178 attached to the backside, as shown in FIG. 1B. During printing, the motor 178 moves the print head 162 into contact with a tape 180 and pushes the tape into contact with the slide 140 (FIG. 4). During printing, the slide carrier 128 is moved to the left, incrementally, per print row, while in contact with the tape 180. This action draws the tape from the print role 170, such that an unprinted section of the tape 180 is interposed between the next print row beneath the print head 162. This incremental movement is continued until the printed information is attached to the slide 140. Subsequently, the printing head 166 is moved away from the slide 140 so that the slide carrier 108 can move the completed slide to the output section 104. The tape has a coated side that is placed in contact with the slide. The coated side has a composition of wax, a wax-resin, or other appropriate composition to be activated by heat and be retained on the slide. The print head 162 has a row of pixel-like heating elements embedded in a ceramic material, not shown, which elements are controlled by a processor (not shown). Based upon the image stored in the processor, the pixel-like elements are appropriately energized to heat to a given temperature to melt the ink composition on the tape.

A user interface section 110 can comprise any of myriad different possible configurations. As shown in the exemplary embodiment in FIGS. 1A and 1B, a control panel and display 182 are used to initiate and control the operation of the printing device 110. As noted previously, the printing information is input into the processor, which transforms the information into a format that is used to drive the heating pixels appropriately. Although a row of pixels is noted, other configurations are clearly possible including, for example, multiple rows of heating pixel elements.

The slide printing device 100 provides the ability to print any specific information onto a slide 140 upon request. The information can be manually entered for each slide or series of slides, downloaded from a database, scanned in via a bar code scanner, and the like. Alternately, the information can be obtained directly from the microtome. The ability to print upon demand helps ensure the printed information matches the desired information respective to the material deposited upon the slide.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method of transferring information onto surfaces of objects comprising:

inputting information into an input device, the input device transforming the information into an image for storage in a printing memory as a stored image;

positioning one or more glass objects in an object storage section by a printing device;

removing one glass object from the storage location into a glass object carrier of the printing device;

indexing the glass object in the carrier to initialize the printing;

transporting the object to a first position under a print head of a printing means for transferring such information to the object;

positioning an ink media tape from a driven feeder between the print head and the glass object;

moving the print head and glass object together to cause the tape to contact the glass object in the carrier;

heating, as required, at least one pixel element in a predetermined manner in the print head to print a row from the stored image by a thermal process to cause an inked media to transfer onto the object as determined by the stored image;

advancing the tape and indexing the object to a next print row and repeating the steps from positioning the tape to transfer the desired information to the object;

after printing the last row of data, separating the print head and object to a non-contact position;

transporting the glass object by the carrier to an output section;

removing the glass object wherein the object is mechanically removed into the output section; and repeating said method as many times as necessary as determined by the operator.

2. The method of transferring information onto surfaces of glass objects as recited in claim 1, wherein the information is related to a patient.

3. The method of transferring information onto surfaces of glass objects as recited in claim 1, wherein the information on the glass object is human and/or machine readable.

4. The method of transferring information onto surfaces of glass objects as recited in claim 1, wherein the glass object has a surface selected from a surfaces group, the surfaces group comprising a flat surface and a curved surface.

5. The method of transferring information onto surfaces of glass objects as recited in claim 4, wherein the information placed on the flat surface is on a slide for receiving medical specimens.

6. The method of transferring information onto surfaces of glass objects as recited in claim 1, wherein the ink media is a wax composition, a wax-resin composition, or a resin composition such that the composition is transferable to the surface by a heat transfer process and becomes permanent thereon before the glass object is removed to the output section.

7. The method of transferring information onto surfaces of glass objects as recited in claim 1, wherein the information is provided via at least one of:

a) manually entered;

b) downloaded from a database;

c) scanned in via a bar code scanner; and d) provided from a microtome.

8. The method of transferring information onto surfaces of glass objects as recited in claim 1, wherein the glass object is composed of a material being at least one of:

a) a clear glass like plastic material;

b) a frosted glass like plastic material;

c) a colored glass like plastic material;

d) a clear glass;

e) a frosted glass; and f) a colored glass.

9. The method of transferring information onto surfaces of glass objects as recited in claim 1, wherein the information is stored as an image to be printed by the print head, as columns and rows, the print head having therein pixel-like heating elements for printing.

10. The method of transferring information onto surfaces of glass objects as recited in claim 1, wherein the printing device is hand transportable by the operator.

11. A printing device for attaching information to a glass like object, the printing device comprising:

an input/interface means for transferring information to the printing device;

a processing means for receiving the information from the input/interface means and transforming the information into an image for printing, the image being stored in a memory of the processing means;

a control means for the input/interface means and the processing means;

a storage section for the objects, the storage section being an integral part of the printing device;

a shuttle having a carrier for removing one of the objects from the storage section in a controlled manner and indexing the object for printing, the shuttle moving the object so indexed to a first print position;

a printing section, the printing section comprising:

a tape feeder, the taper feeder being driven by the processing means, a tape from the tape feeder being positioned for printing in close proximity to the glass like object in the first print position;

a print head, the print head having a plurality of heating pixel elements in a row for printing the stored image by a thermal process to cause an inked media to transfer onto the object as determined by the stored image, after printing data in the first print position, the print head and tape are advanced to the next printing position, this is repeated until the stored image is printed on the glass like object, after printing the stored image, the print head and glass like object separate to a non-contact position, and the carrier moves the glass like object therefrom; and an output section, the object with a printed image thereon is moved to the output section, after which another glass like object is removed from the storage section by the carrier if so required and the process repeated as necessary.

12. The printing device for attaching information to a glass like object, the printing device as recited in claim 11, wherein the information is related to a patient.

13. The printing device for attaching information to a glass like object, the printing device as recited in claim 11, wherein the information on the glass like object is human and/or machine readable.

14. The printing device for attaching information to a glass like object, the printing device as recited in claim 11, wherein the glass like object has a surface selected from a surfaces group, the surfaces group comprising a flat surface and a curved surface.

15. The printing device for attaching information to a glass like object, the printing device as recited in claim 14, wherein the information placed on the flat surface is on a slide for receiving medical specimens.

16. The printing device for attaching information to a glass like object, the printing device as recited in claim 11, wherein the ink media is a wax composition, a wax-resin composition, or an appropriate composition such that the composition is transferable to the surface by a heat transfer process and becomes permanent thereon before the glass like object is removed to the output section.

17. The printing device for attaching information to a glass like object, the printing device as recited in claim 13, wherein the information is related to a patient.

18. The printing device for attaching information to a glass like object, the printing device as recited in claim 11, wherein the object is at least one of:

a) a clear glass like plastic material;

b) a frosted glass like plastic material;

c) a colored glass like plastic material;

d) a clear glass;

e) a frosted glass; and f) a colored glass.

19. The printing device for attaching information to a glass like object, the printing device as recited in claim 11, wherein the information is stored as an image to be printed by the print head, as columns and rows, the print head having therein pixel-like heating elements for printing.

20. The printing device for attaching information to a glass like object, the printing device as recited in claim 11, wherein the printing device is hand transportable by the operator.

* * * * *

UNITED STATES PATENT AND TRADEMARK OFFICE

CERTIFICATE OF CORRECTION

PATENT NO. : 8,013,884 B2
APPLICATION NO. : 12/147407
DATED : September 6, 2011
INVENTOR(S) : Jamie P. Schlinkmann, Alex W. Schlinkmann and Antonio L. Haubrich It is certified that error appears in the above-identified patent and that said Letters Patent is hereby corrected as shown below:

On the Title Page:

Correct the information provided for Inventor "Antinio" L. Haubrich such that it reads:

[76] "Antonio" L. Haubrich, Sunrise FL (US)

Signed and Sealed this
Thirteenth Day of November, 2012

David J. Kappos

David J. Kappos
*Director of the United States Patent and Trademark Office*

(12) INTER PARTES REVIEW CERTIFICATE (65th)

United States Patent
Schlinkmann et al.

(10) Number: US 8,013,884 K1
(45) Certificate Issued: Mar. 23, 2015

(54) DEVICE AND METHOD FOR PRINTING INFORMATION ON GLASS SURFACES

(75) Inventors: Jamie P. Schlinkmann; Alex W. Schlinkmann; Antinio L. Haubrich

(73) Assignee: Automatic Manufacturing Systems, Inc.

Trial Number:

IPR2013-00196 filed Mar. 19, 2013

Petitioner: Primera Technology, Inc.

Patent Owner: Automatic Manufacturing Systems, Inc.

Inter Partes Review Certificate for:

| | |
|---|---|
| Patent No.: | **8,013,884** |
| Issued: | **Sep. 6, 2011** |
| Appl. No.: | **12/147,407** |
| Filed: | **Jun. 26, 2008** |

The results of IPR2013-00196 are reflected in this inter partes review certificate under 35 U.S.C. 318(b).

INTER PARTES REVIEW CERTIFICATE
U.S. Patent 8,013,884 K1
Trial No. IPR2013-00196
Certificate Issued Mar. 23, 2015

AS A RESULT OF THE INTER PARTES REVIEW PROCEEDING, IT HAS BEEN DETERMINED THAT:

Claims 1-20 are cancelled.

* * * * *